US005777280A

United States Patent [19]

Braasch et al.

[11] Patent Number: 5,777,280

[45] Date of Patent: Jul. 7, 1998

[54] CALIBRATION ROUTINE WITH ADAPTIVE LOAD COMPENSATION

[75] Inventors: Burkhard Braasch; Marvin Dehmlow; Jürgen Dieluweit; Christoph M. Ernecke; Thomas Gietzold, all of Berlin, Germany; Alberto Vecchiotti, Middletown, Conn.

[73] Assignee: Otis Elevator Company, Farmington, Conn.

[21] Appl. No.: 708,137

[22] Filed: Aug. 27, 1996

[51] Int. Cl.[6] ..... B66B 1/34; B66B 3/00; B66B 1/40

[52] U.S. Cl. ..... 187/393; 187/291

[58] Field of Search ..... 187/292, 295, 187/294, 391, 393, 394

[56] References Cited

U.S. PATENT DOCUMENTS

| | | | |
|---|---|---|---|
| 3,619,750 | 11/1971 | Mokrytzki et al. | 318/231 |
| 4,869,347 | 9/1989 | Takahashi | 187/112 |
| 4,982,816 | 1/1991 | Doi et al. | 187/119 |
| 5,077,508 | 12/1991 | Wycoff et al. | 318/436 |
| 5,157,228 | 10/1992 | Ackermann et al. | 187/112 |
| 5,229,558 | 7/1993 | Hakala | 187/118 |
| 5,325,036 | 6/1994 | Diethert et al. | 318/802 |
| 5,345,048 | 9/1994 | Towey, Jr. | 187/116 |
| 5,531,294 | 7/1996 | Curton et al. | 187/292 |
| 5,677,519 | 10/1997 | Herkel et al. | 187/291 |

FOREIGN PATENT DOCUMENTS 0607646 7/1994 European Pat. Off. .

OTHER PUBLICATIONS

Abstract of Jpanese Patent Application Laid open JP 401252193A: Speed Controller for Inverter; Doi Kazuhiko, Yamada Koji, Oct. 6, 1989.

Copy of U.S. patent application Ser. No. 08/610,101 entitled "Elevator Leveling Adjustment" filed Feb. 29, 1996, Peter Herkel, et al.

Copy of U.S. patent application Ser. No. 08/708,138 entitled "Adaptive Load Compensation for an Elevator System" filed Aug. 27, 1996, Christophe M. Ernecke, et al.

*Primary Examiner*—Robert Nappi

[57] ABSTRACT

A load compensation calibration method for an elevator controller includes the steps of moving an elevator car in a first direction, the first direction a first creep speed region; determining the time to travel a given distance; during the first run; determining a first actual creep speed of the first creep speed region; determining a difference between a dictated creep speed and the first actual creep speed; determining a first compensation frequency for minimizing the difference between the dictated creep speed and the first actual creep second; moving the elevator car in a second direction, the speed direction including a second creep speed region; determining the time to travel a given distance during the second run; determining a second actual creep speed of the second creep speed region; determining a difference between a dictated creep speed and the second actual creep speed; determining a second compensation frequency for minimizing the difference between the dictated creep speed and the second actual creep speed; and creating a load compensation characteristic in response to the time to travel a given distance and the first and second compensation frequencies.

4 Claims, 4 Drawing Sheets

LOAD COMPENSATION CHARACTERISTIC

CALIBRATION ROUTINE WITH ADAPTIVE LOAD COMPENSATION

TECHNICAL FIELD

The present invention relates to generally to elevators and, in particular, relates to elevator load compensation.

BACKGROUND ART

Modern elevator systems utilize sophisticated software and controllers which control most aspects of the elevators operation. The controllers gather information from various sources in the elevator system and use that information to efficiently operate the elevator. Thus, elevator speed, starting, stopping, dispatching, floor positioning or leveling, and the like are all governed by the controller. However, each of these functions are affected by an elevator load. For example, an increase in the load can cause a decrease in elevator speed. Load information is especially useful in providing accurate stopping at the various landings in the building.

In a closed loop elevator system, functions which are affected by the load are generally compensated by using an encoder which measures motor shaft revolutions and translates the results into machine readable signals delivered to the controller microprocessor. The controller uses these signals to determine if the load has caused any deviations in the functions of the elevator car. If a deviation is detected, then the controller attempts to provide appropriate compensation. For example, if the load causes a change in speed, the encoder detects it and provides speed compensation in response to the change. The encoder, however, introduces added expense and complexity into the elevator system. Additionally, the encoder must be configured to cooperate with a large number of different motor designs. Thus, the cost of modernizing a large variety of elevator systems is very high. Accordingly, it is desirable to provide elevator load compensation method without the use of an encoder.

DISCLOSURE OF THE INVENTION

It is an object of the present invention to provide a method for calibrating an elevator controller for providing improved performance under various load conditions.

According to the present invention, a load compensation calibration method for an elevator controller comprises the steps of: moving an elevator car in a first direction, the first direction including a first creep speed region; determining a first travel time in response to moving the elevator car in the first direction; determining a first actual creep speed of the first creep speed region; determining a difference between a dictated creep speed and the first actual creep speed; determining a first compensation frequency for minimizing the difference between the dictated creep speed and the first actual creep speed; moving the elevator car in a second direction, the second direction including a second creep speed region; determining a second travel time in response to moving the elevator car in the second direction; determining a second actual creep speed of the second creep speed region; determining a difference between a dictated creep speed and the second actual creep speed; determining a second compensation frequency for minimizing the difference between the dictated creep speed and the second actual creep speed; and creating a load compensation characteristic in response to the travel time and the first and second compensation frequencies.

BEST MODE FOR CARRYING OUT THE INVENTION

Figure 1:
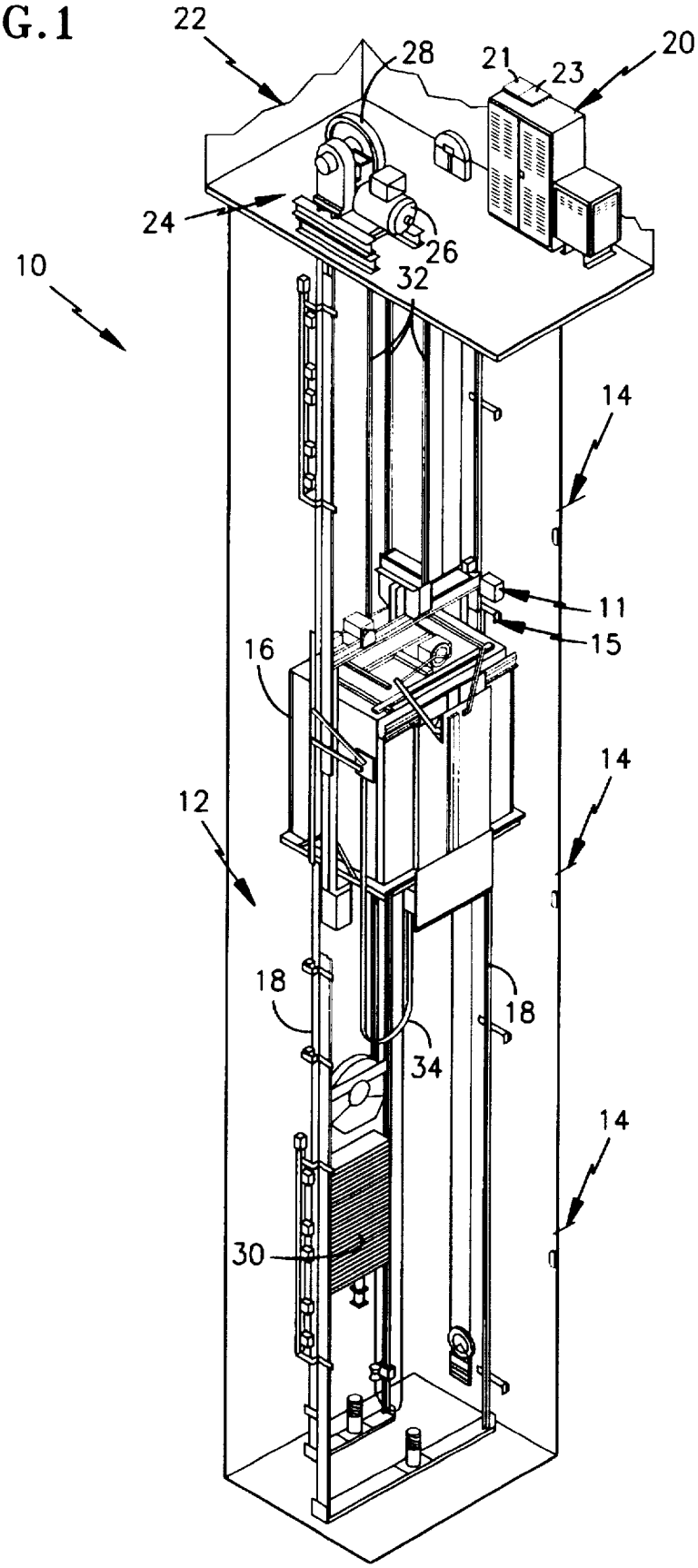
FIG. 1 is a perspective view of a elevator system employing a preferred embodiment of the present invention.

Referring to FIG. 1, an elevator system 10 employing a preferred embodiment of the present invention is shown. The elevator system 10 is disposed in a building having a plurality of floors. The building includes a hoistway 12 with a plurality of landings 14 that correspond to the plurality of floors. An elevator car 16 is disposed in the hoistway 12 such that the elevator car 16 may travel along the elevator guide rails 18 disposed vertically in the hoistway 12. A pair of leveling sensors 11, including a first leveling sensor and a second leveling sensor, is attached to the elevator car 16 so that the sensors 11 detect magnets 15 disposed in the hoistway 12 as the elevator car 16 travels in the hoistway 12. The first leveling sensor and the second leveling sensor are spaced apart with respect to each other by a predetermined fixed distance and are normally used for facilitating leveling the elevator car 16 at the plurality of landings 14.

An elevator controller 20, disposed in a machine room 22, monitors and provides system control of the elevator system 10. The elevator controller 20 provides a control signal to a motive apparatus 24 for controlling the movements of the elevator car 16 within the hoistway 12 as is explained herein below. The controller 20 includes a processor 21 and a memory 23. In one embodiment, the processor 21 is a commercially available microcontroller such as an Intel 80C196 and the memory 23 is a commercially available memory such as a NECμPD43256AGU-85L (32K×8 bit static CMOS RAM). The processor 21 executes commands which are stored in the memory 23. One such set of commands enables the controller 20 to control the operation of an elevator drive 25 (FIG. 2) and thus the speed of a motor 26. Another set of commands enables the controller 20 to respond to various load conditions as is explained herein below.

The motive apparatus 24 provides a means to move the elevator car 16 in the hoistway 12 and is responsive to the controller 20 such that the elevator car moves in the hoistway at a dictated speed according to the control signal. In one embodiment the motive apparatus 24 includes the drive 25, the motor 26, a drive sheave 28, a counterweight 30 and hoist ropes 32.

The motor 26 is drivenly associated with the drive sheave 28 such that a rotational output of the motor 26 is transferred to the drive sheave 28. The rotational output of the motor 26 is transmitted to the elevator car 16 by the hoist ropes 32 guided around the drive sheave 28; the elevator car 16 being at one end of the hoist ropes 32 and the counterweight 30 at the other. A traveling cable 34 is used to provide an electrical connection between the elevator controller 20 and electrical equipment in the elevator car 16. The drive 25 is electrically connected to the motor 26 such that the drive 25 dictates the motor speed in response to the control signal as is explained below. Of course, it should be realized that the present invention can be used in conjunction with other elevator systems including hydraulic and linear motor systems, among others.

Figure 2:
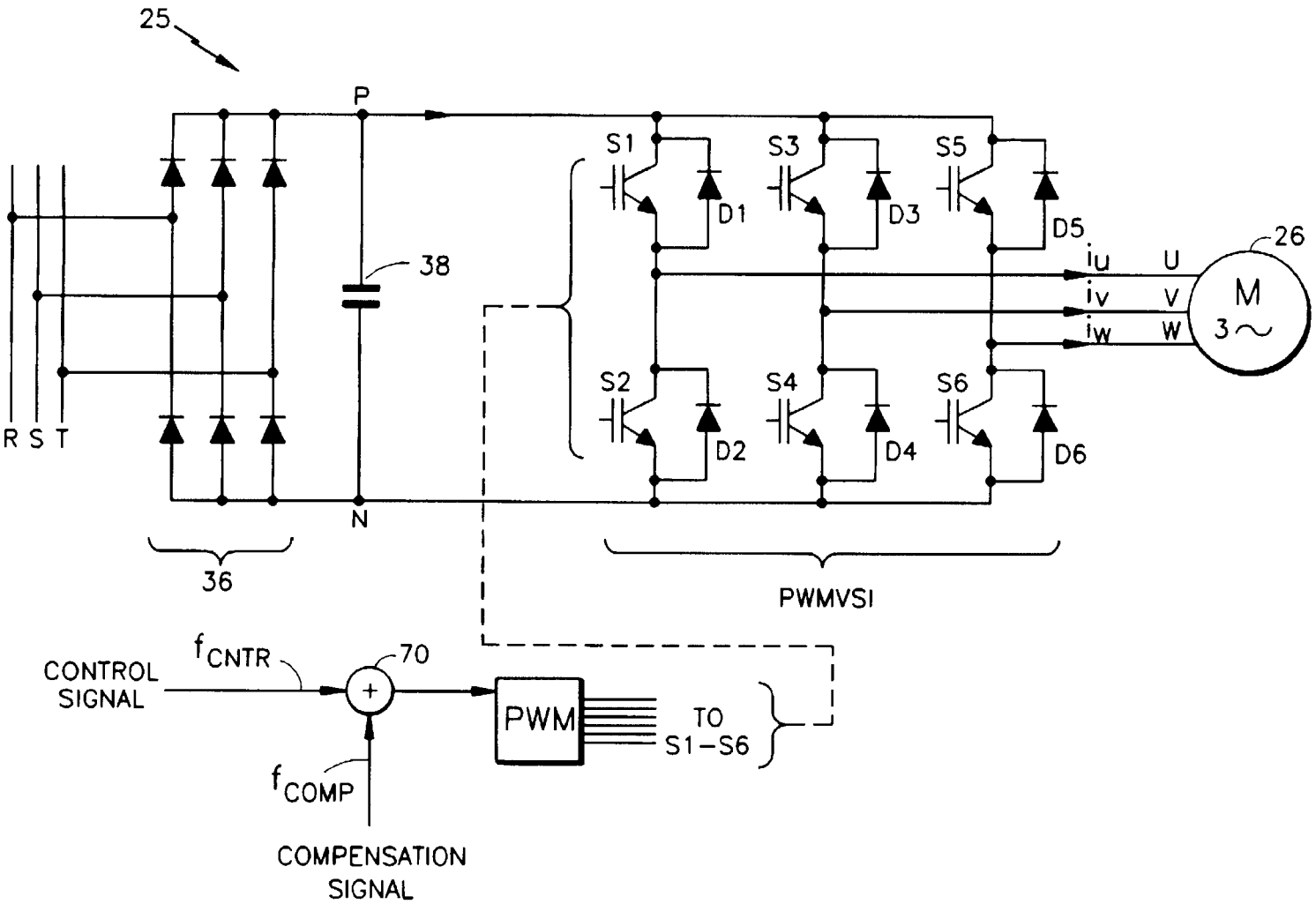
FIG. 2 is a schematic diagram of an elevator drive.

Referring to FIG. 2, the drive 25 is described illustratively in the context of a preferred embodiment of a pulse width modulated motor drive. The motor 26 is supplied with alternating currents $i_u$, $i_v$, $i_w$ from a pulse width modulating voltage source inverter ("PWMVSI") connected to a voltage DC source 36 through a DC-Link comprising terminals of opposite polarities P, N and a capacitor bank 38. The DC source 36 in general is achieved with a rectifier, or an AC/DC converter, supplied with an AC power from supply lines RST.

The PWMVSI, in one embodiment, comprises a plurality of switches S1–S6, such as IGBTs. Connected across each switch S1–S6 is a free-wheeling diode D1–D6 for providing a path for reactive current flow. Actuation of the switches S1–S6 in the PWMVSI occurs in accordance with one of many pulse width modulation schemes well known in the art. Accordingly, the motor currents $i_u$, $i_v$, $i_w$ are controlled by a pulse width modulator PWM which provides a plurality of switching signals in response to the control signal provided by the controller 20. A frequency $f_{CNTR}$ of the control signal is representative of a desired speed of the motor 26 for achieving the dictated speed of the elevator car 16. The switching signals are provided to the inverter switches S1–S6 so that the output current signals $i_u$, $i_v$, $i_w$ of the PWMVSI correspond to the desired speed of the motor 26. Thus, control of the motor speed, motor acceleration and motor deceleration is achieved. The present invention, however, may be implemented with other schemes for controlling the switching, whether of the pulse width modulation variety or some other, without departing from the spirit or scope of the present invention.

Figure 3:
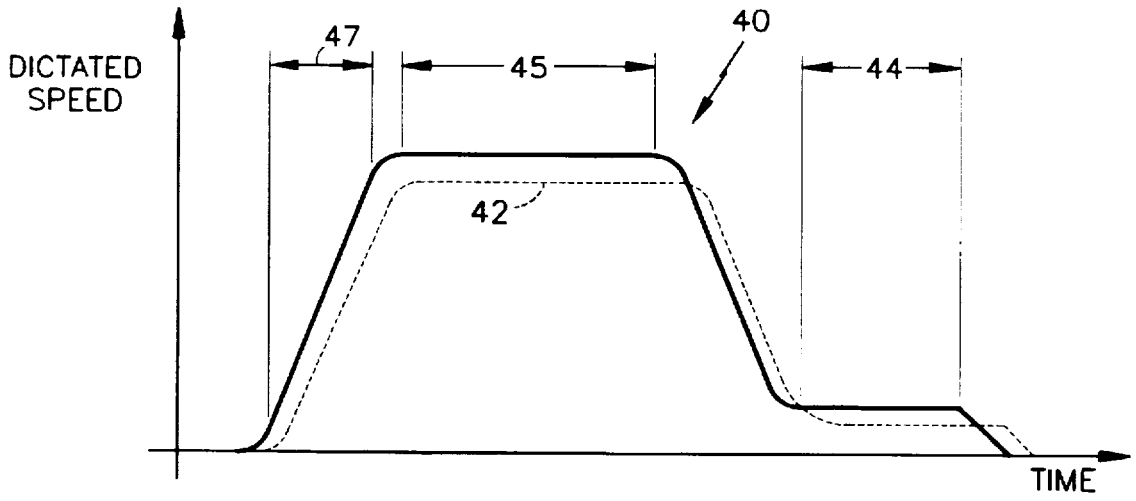
FIG. 3 is a diagram of an elevator car speed profile as dictated by a control signal.

Referring to FIG. 3, an elevator car speed profile 40, as dictated by the control signal, is shown as a function of time. As shown by dashed line 42, an increase in the load can cause a reduction in the speed of the elevator car 16; this becomes important in a creep speed region 44 because it affects the elevator system's ability to properly level at the landings 14. Accordingly, the present invention provides a compensation signal having a compensation frequency $f_{COMP}$ which is based, in part, on the DC-Link signal as is described below.

The present invention is predicated, in part, on the discovery that the time required for the elevator to travel a given distance in response to a command is proportional to the load of the elevator car. For example, the present inventors have discovered that the time required to travel a given distance during acceleration from a stop increases substantially proportionately to increases in the load. Accordingly, a method for calibrating the controller 20 to provide the compensation signal in response to the varying loads is described below.

Figure 4:
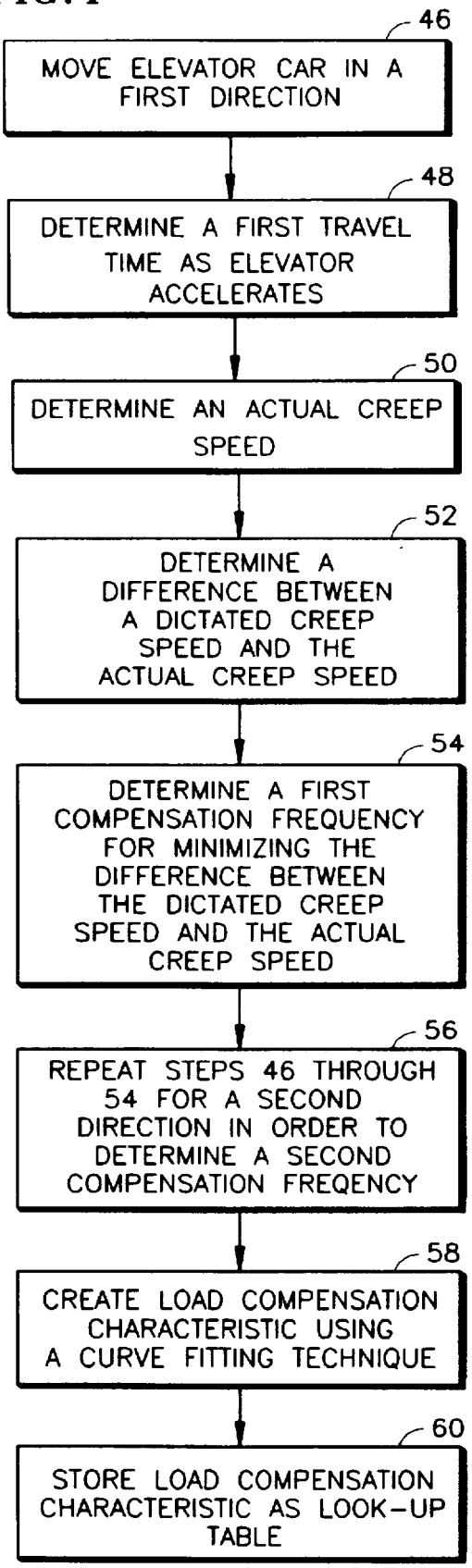
FIG. 4 is a flow diagram illustrating a calibration of an elevator controller.

Referring to FIGS. 3 and 4, the controller 20 operates in accordance with the principles of the present invention as is explained herein. In order to calibrate the controller 20, an empty elevator car is moved in a first direction in step 46. For example, the controller 20 may move the elevator car 16 in the up direction which, as a result of the counterweight 30, represents an almost empty load.

As the elevator car 16 initiates travel in an acceleration region 47, the elevator can 16 enters a constant speed region 45 where the speed of the controller 20, in step 48, determines a travel time i.e., the time required for the elevator car 16 to travel a predetermined distance. The travel time is used because it is a function of the load. The travel time is determined under varying load conditions. For example, the first direction run represents one load condition and the second direction run represents another load condition as is explained above. Preferably, the time between the falling edges of the first and second leveling signals can be measured and used as the travel time. In one embodiment, the travel time is determined as the elevator car 16 is in the acceleration region 47 while departing from a landing 14.

In one embodiment, the time is determined by using the pair of leveling sensors 11 (shown in FIG. 1). The pair of sensors 11 are conventionally used to detect magnets 15 (also shown in FIG. 1) for leveling purposes as is described above. However, the sensors may be used to determine the time to travel a distance as is described herein below.

As stated above, the predetermined distance between the pair of sensors 11 is known. The time between the activation of the first leveling sensor and the second leveling sensor is calculated by a timer built into the processor 21. When the first leveling sensor is activated, in response to sensing the magnet 15, the first leveling sensor generates a first leveling signal. The first leveling signal is used as an interrupt signal such that it causes a time measurement to be initiated and a value of the timer to be stored in the memory 23. When the second leveling sensor is activated, in response to detecting the magnet 15, the second leveling signal is generated which is also used as an interrupt signal. The second leveling signal ends the time measurement and a value of the timer is again stored in the memory 23. The difference between these two timer values multiplied by a constant is a time measurement value, i.e., the time required to cross the predetermined distance between the first and second leveling sensors. The constant, in one embodiment, is 1.6 μs per timer count, i.e., the timer is incremented every 1.6 μs by the processor 21 so that if we count 1000 counts then the elapsed time is 1.6 ms. The counter is automatically incremented by the processor 21 and no software is required. Alternatively, the timer may be implemented, for example, in software as would be understood by one skilled in the art in light of the present specification.

Next, in step 50, the controller 20 determines an actual creep speed; this is the speed of the elevator car 16 while it is traveling in the creep speed region 44. In one embodiment, the actual creep speed of the elevator car 16 is determined by using the formula: speed=distance/time. The time is again determined as described above, but at the end of the run, at creep speed. Finally, the actual creep speed of the elevator is determined by the processor 21 by dividing the predetermined distance by the time measurement value. For example, if the predetermined distance is 3 cm and the time measurement value is 270 ms then the actual creep speed is 11.1 cm/s. Of course, it should be realized that the actual creep speed could be determined by other means without departing from the spirit or scope of the present invention.

Next, the controller compares the actual creep speed to a dictated creep speed in step 52. The dictated creep speed is the desired speed of the elevator car 16 while the car 16 is traveling in the creep speed region 44 and is determined by the controller 20. In one embodiment, the dictated creep speed is 10 cm/s. However, varying loads may cause the elevator car 16 to travel at speeds other than the dictated creep speed in the creep speed region 44. For example, during an up direction run, the first direction in the example above, the empty car represents an almost empty car and may result in a speed faster than the dictated creep speed in the creep speed region 44. Thus, in step 52, the controller 20 determines the difference between the dictated creep speed and the actual creep speed.

The controller 20, in step 54, determines a first compensation frequency $f_{c1}$ for minimizing the difference between the dictated creep speed and the actual creep speed. Once determined, a compensation signal having this compensation frequency $f_{c1}$ can be added or subtracted to the control signal having the frequency $f_{CNTR}$ to provide compensation for speed deviations as is described in detail below.

The compensation frequency $f_{COMP}$ is derived directly from the difference between the dictated creep speed and the actual creep speed because the speed of the motor varies substantially proportionally with the frequency $f_{CNTR}$ of the control signal. For example, assuming we have no load, if a control signal frequency $f_{CNTR}$ of 25 Hz produces a creep speed of 5 cm/s then a control signal frequency $f_{CNTR}$ of 50 Hz will produce a creep speed of 10 cm/s. Therefore, if the dictated creep speed is 10 cm/s and a load causes the elevator car 16 to travel at only 5 cm/s then the compensation frequency $f_{COMP}$ is 50 Hz. Accordingly, a compensation signal having the compensation frequency $f_{COMP}$ of 50 Hz is added to the control signal having the frequency $f_{CNTR}$ of 50 Hz to adjust the actual creep speed to the dictated creep speed as is described herein below.

Step 46 through step 54 are repeated for a second direction in step 56 in order to determine a second compensation frequency $f_{c2}$. For example, the controller 20, in step 46, may move the elevator car 16 in the down direction which, as a result of the counterweight 30, represents an almost full load. Thus, in step 54, in this example, the controller 20 determines the second compensation frequency $f_{c2}$ which is used to compensate for an almost full load in the elevator car 16.

Figure 5:
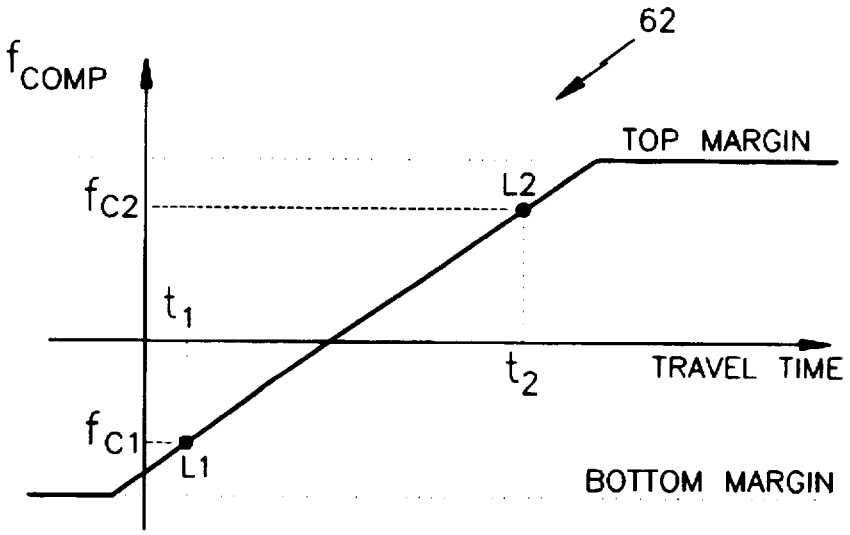
FIG. 5 is an illustration of a load compensation characteristic.

Referring to FIGS. 4 and 5, after the first and second compensation frequencies $f_{c1}$, $f_{c2}$ have been determined for their respective times to travel a given distance, in step 58, the controller 20 creates a load compensation characteristic 62 (FIG. 5), by using the information obtained in steps 48 and 54. For example, the time $t_1$ detected during the first direction run and the compensation frequency $f_{c1}$ corresponding thereto both define an empty load compensation point $L_1$. Likewise, the time $t_2$ detected during the second direction run and the corresponding compensation frequency $f_{c2}$ determined for this run both define a full load compensation point $L_2$. The load compensation characteristic 62 is created by using a known curve fitting technique to approximate the curve between the two load compensation points $L_1$, $L_2$. In one embodiment, a linear regression curve fitting technique is utilized. However, one skilled in the art should realize that other curve fitting techniques may be used without departing from the spirit or scope of the present invention.

The load compensation characteristic has a top and bottom margin in order to prevent overcompensation in the event of a drive fault, such as a failure in the sensor 39. Once the load compensation characteristic 62 has been created in step 58, the calibration of the controller is complete and the controller 20 stores the load compensation characteristic 62 in the memory 23 as a look-up table so that the controller 20 may use the table in compensating for varying loads as is described below.

The load compensation characteristic of the calibration method described above incorporates the individual characteristics of each elevator system to which it is applied. Accordingly, the present invention can be applied to a wide variety of elevator systems without the need to include a speed encoder. Additionally, the calibration method may be applied during installation of the elevator system and again at a later time to provide adaptive fine tuning of the load compensation characteristic. For example, the calibration method may be applied periodically such as once every month.

Figure 6:
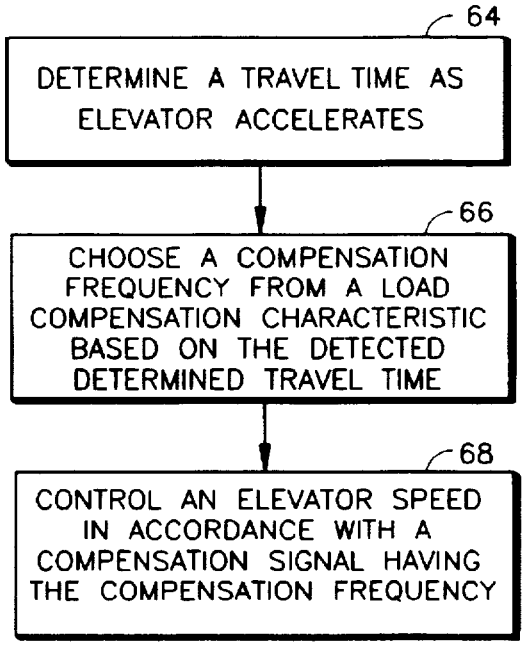
FIG. 6 is a flow diagram illustrating the utilization of the load compensation characteristic in an elevator system for providing adaptive load compensation.

Referring to FIG. 6, begin at step 64, the controller 20 detects the time to travel a distance as it accelerates in region 47 in each elevator run. Next, in step 66, the controller 20 uses the load compensation characteristic of FIG. 5 to determine the compensation frequency $f_{COMP}$ which corresponds to the determined time to travel a distance. Once the appropriate compensation frequency $f_{COMP}$ has been selected from the load compensation characteristic, the controller 20 in step 68 controls the elevator speed in accordance with the compensation signal having the compensation frequency $f_{COMP}$. In one embodiment, the compensation signal is added to the control signal in a summing circuit 70 (FIG. 2) so that the speed of the elevator car 16 is controlled under actual load conditions in order to achieve the dictated speed of the elevator car. For example, the compensation signal is added to the control signal during the creep speed region 44 in order to achieve the dictated creep speed and improve the elevator system's ability to properly level the elevator car 16 at the landings 14.

The invention is advantageous if the speed profile 40 does not include a constant speed region 45 sufficient to accurately detect the DC-Link signal or to use other alternative methods.

Thus, an elevator controller calibrated in accordance with the present invention includes the advantage of providing compensation for varying loads without the need for an encoder, or other closed loop device, which results in less complexity and lower costs. Costs are especially reduced in modernization efforts as a result of eliminating the high costs associated with configuring encoders to cooperate with a large number of different motor designs.

Various changes to the above description may be made without departing from the spirit and scope of the present invention as would be obvious to one of ordinary skill in the art of the present invention.

What is claimed is:

1. A load compensation calibration method for an elevator controller, comprising the steps of:

moving an elevator car in a first direction, the first direction including a first creep speed region;

determining a first time to travel a known distance as the elevator car accelerates in the first direction;

determining a first actual creep speed of the first creep speed region;

determining a difference between a dictated creep speed and the first actual creep speed;

determining a first compensation frequency for minimizing the difference between the dictated creep speed and the first actual creep speed;

moving the elevator car in a second direction, the second direction including a second creep speed region;

determining a second time to travel said known distance as the elevator car accelerates in the second direction;

determining a second actual creep speed of the second creep speed region;

determining a difference between the dictated creep speed and the second actual creep speed;

determining a second compensation frequency for minimizing the difference between the dictated creep speed and the second actual creep speed; and creating a load compensation characteristic in response to the first travel time, the second travel time, the first compensation frequency and the second compensation frequency.

2. A load compensation calibration method as recited in claim 1, in which the last step comprises the steps of:

determining a first load compensation point in response to determining the first travel time and the first compensation frequency; and determining a second load compensation point in response to determining the second travel time and the second compensation frequency.

3. A load compensation calibration method as recited in claim 2. wherein the load compensation characteristic is created by implementing a curve fitting technique to approximate the curve between the two load compensation points.

4. A load compensation calibration method as recited in claim 3 wherein the curve fitting technique is a linear regression curve fitting technique.

* * * * *